US007654522B2

(12) United States Patent
Tonami

(10) Patent No.: US 7,654,522 B2
(45) Date of Patent: Feb. 2, 2010

(54) SHEET FEEDER WITH ULTRASONIC DOUBLE FEED DETECTOR

(75) Inventor: Kazumasa Tonami, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 294 days.

(21) Appl. No.: 11/783,076

(22) Filed: Apr. 5, 2007

(65) Prior Publication Data

US 2007/0235922 A1 Oct. 11, 2007

(30) Foreign Application Priority Data

Apr. 7, 2006 (JP) ..... 2006-106623

(51) Int. Cl.
*B65H 7/12* (2006.01)

(52) U.S. Cl. ..... 271/262; 271/265.04

(58) Field of Classification Search ..... 271/258.01, 271/262, 265.04, 263

See application file for complete search history.

(56) References Cited

U.S. PATENT DOCUMENTS

2003/0006550 A1* 1/2003 Chujo et al. ..... 271/262

2005/0189707 A1* 9/2005 Sano et al. ..... 271/242

FOREIGN PATENT DOCUMENTS

| | | |
|---|---|---|
| JP | 1-68349 | 5/1989 |
| JP | 2005-162426 A | 6/2005 |

* cited by examiner

*Primary Examiner*—Patrick H Mackey
*Assistant Examiner*—Gerald W McClain
(74) *Attorney, Agent, or Firm*—Birch, Stewart, Kolasch & Birch, LLP

(57) ABSTRACT

A sheet feeder includes: a feeding roller for feeding a sheet; a press member for pressing the sheet against the feeding roller; and a double feed detector for detecting double feed of the sheets when the sheets are fed in superimposition; wherein the feeding roller and the press member are opposed each other at a sheet holding portion for holding the sheet to be fed therebetween, and the double feed detector is placed to be able to detect double feed of the sheets in a region being adjacent to the sheet holding portion, an amplitude of the sheet being suppressed in the region.

3 Claims, 8 Drawing Sheets

SHEET FEEDER WITH ULTRASONIC DOUBLE FEED DETECTOR

CROSS-REFERENCE TO RELATED APPLICATIONS

This application is related to Japanese patent application No. 2006-106623 filed on Apr. 7, 2006, whose priority is claimed under 35 USC § 119, the disclosure of which is incorporated by reference in its entirety.

BACKGROUND OF THE INVENTION

1. Field of the Invention

The present invention relates to a sheet feeder and, more particularly, to a sheet feeder equipped with a function of detecting double feed of sheets.

2. Description of the Related Art

There has been known a conventional sheet feeder relevant to the present invention including: a sheet supplying roller for feeding a sheet from a sheet supplying portion; a registration roller arranged at a predetermined interval from the sheet supplying roller; a wave transmitter provided on the way of a sheet feed path extending from the sheet supplying roller to the registration roller, for transmitting an ultrasonic wave; and a wave receiver for receiving the ultrasonic wave transmitted from the wave transmitter; wherein the wave transmitter transmits the ultrasonic wave to a sheet in the state in which the sheet is held between both of the sheet supplying roller and the registration roller, so that it is detected, by comparing an attenuation degree of the ultrasonic wave received by the wave receiver with a predetermined threshold, as to whether or not the sheets are doubly fed (see, for example, Japanese Unexamined Patent Publication No. 2005-162426).

In recent years, high-speed printing has been progressed in an image forming apparatus such as a copying machine or a printer.

For this purpose, a sheet feeder mounted on the image forming apparatus has been required to feed a sheet such as a document or a recording medium at a high speed.

However, there has been a high possibility of double feed of sheets in superimposition when a sheet is fed from a sheet supplying portion having sheets contained therein or stacked thereon onto a sheet feed path if the sheet is to be forcibly fed at a high speed.

Double feed of the sheets in superimposition is a major cause of a paper jam.

Even if no paper jam is caused, there occurs an inconvenience that an image different from an image to be read by an image reading unit is read in the doubly fed state, or that an image to be formed on a single sheet is formed over a plurality of superimposed sheets in an image forming unit.

As a consequence, the sheets cannot be sufficiently fed at a high speed only by increasing drive speed of feeding means such as a sheet supplying roller or a feeding roller. A function of securely detecting double feed of the sheets is required in the case where the sheets are fed in superimposition onto the sheet feed path.

Examples of means for detecting double feed of the sheets generally include an ultrasonic wave sensor disposed on the sheet feed path.

Such an ultrasonic wave sensor is constituted of a wave transmitter, which transmits an ultrasonic wave, and a wave receiver, which receives the ultrasonic wave transmitted from the wave transmitter so as to convert the ultrasonic wave into electric energy.

An attenuation degree of the ultrasonic wave received by the wave receiver can be compared with a predetermined threshold by utilizing the attenuation of the ultrasonic wave transmitted from the wave transmitter when the ultrasonic wave passes through the sheet, thereby detecting as to whether or not the sheets are doubly fed.

However, since the ultrasonic wave is transmitted via air as a medium, an output from the wave receiver is fluctuated if an amplitude, that is, a fluctuation of the sheet on the sheet feed path is large, thereby making it difficult to securely detect double feed.

In the above-described prior art, the ultrasonic wave is transmitted from the wave transmitter in the state in which the sheet is held between both of the sheet supplying roller and the registration roller, thus eliminating the fluctuation of the output from the wave receiver caused by the fluctuation of the sheet.

However, the sheet feeding is once stopped by the registration roller after the sheet is fed from the sheet supplying roller, and then, the sheet is held between both of the sheet supplying roller and the registration roller. Therefore, there is a limitation from the viewpoint of the sheet feeding at a high speed.

In addition, a design is limited such that the sheet supplying roller and the registration roller must be arranged with an interval shorter than the length of a sheet having a smallest size, and further, that the ultrasonic wave sensor must be interposed between the sheet supplying roller and the registration roller.

SUMMARY OF THE INVENTION

In view of the foregoing, the present invention is directed to a sheet feeder being capable of securely detecting double feed of sheets while feeding the sheets at a high speed.

According to the present invention, there is provided a sheet feeder, which comprises: a feeding roller for feeding a sheet; a press member for pressing the sheet against the feeding roller; and a double feed detector for detecting double feed of the sheets when the sheets are fed in superimposition; wherein the feeding roller and the press member are opposed each other at a sheet holding portion for holding the sheet to be fed therebetween, and the double feed detector is placed to be able to detect double feed of the sheets in a region being adjacent to the sheet holding portion, an amplitude of the sheet being suppressed in the region.

According to the present invention, the double feed detector is placed in such a manner as to detect double feed of the sheets in the region being adjacent to the sheet holding portion, the amplitude of the sheet being suppressed in the region. Therefore, double feed of the sheets can be securely detected without being influenced by the amplitude of the sheet, while feeding the sheets at a high speed.

DESCRIPTION OF THE PREFERRED EMBODIMENTS

Figure 1:
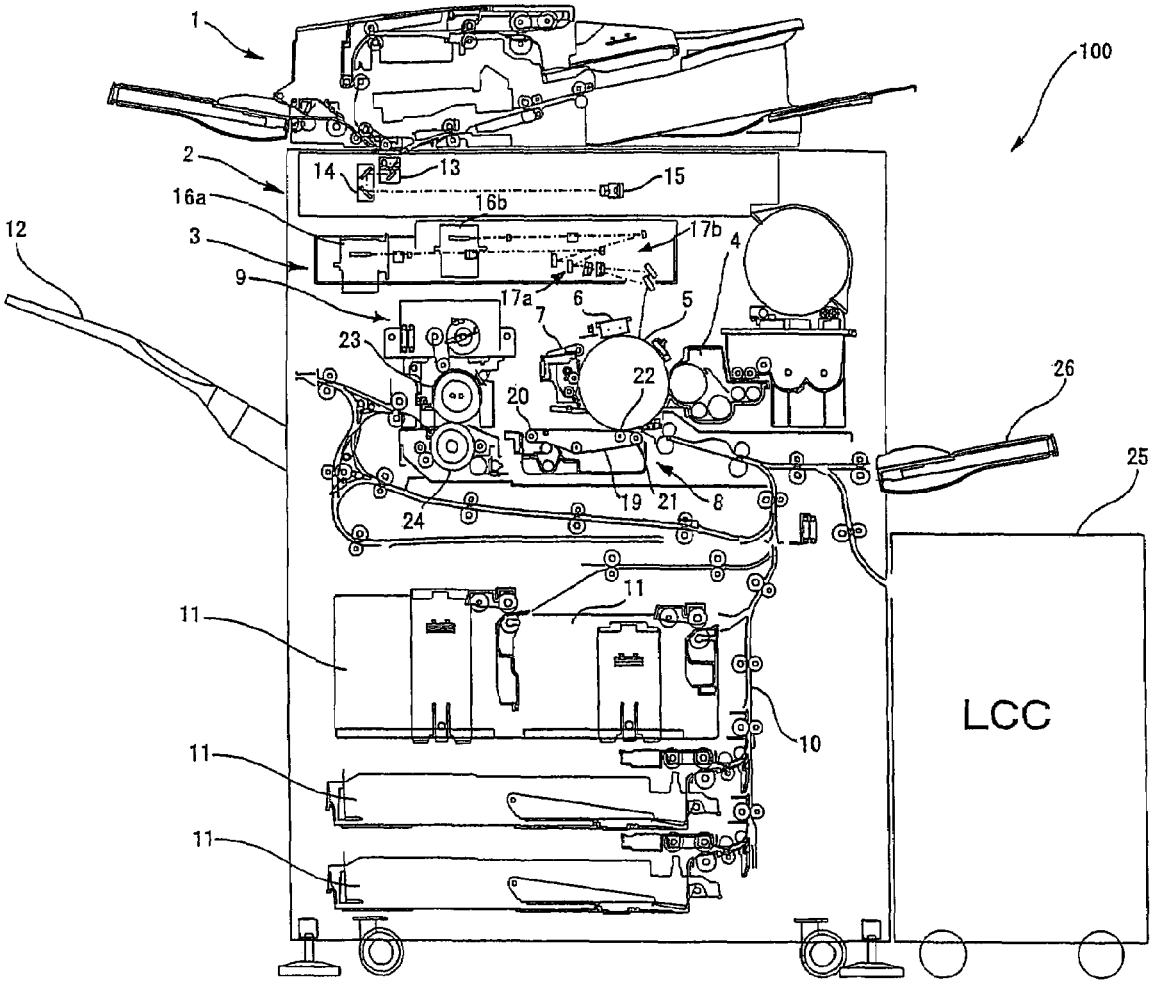
FIG. 1 is a schematic view showing the entire configuration of an image forming apparatus mounting an ADF thereon according to a preferred embodiment of the present invention.

A sheet feeder according to the present invention comprises: a feeding roller for feeding a sheet; a press member for pressing the sheet against the feeding roller; and a double feed detector for detecting double feed of the sheets when the sheets are fed in superimposition; wherein the feeding roller and the press member are opposed each other at a sheet holding portion for holding the sheet to be fed therebetween, and the double feed detector is placed to be able to detect double feed of the sheets in a region being adjacent to the sheet holding portion, an amplitude of the sheet being suppressed in the region.

In the inventive sheet feeder, the feeding roller basically means a roller for applying frictional force to the sheet in the sheet feed direction so as to feed the sheet. The feeding roller may be equipped with a function of reversely rotating and applying frictional force to the sheet in a direction reverse to the feed direction, so as to eliminate double feed upon detection of double feed of the sheets, or may be equipped with a function of temporarily chucking and stopping the sheet, so as to feed the sheet at a predetermined feed timing.

As a consequence, the feeding roller may be a sheet supplying roller, a pickup roller, a registration roller disposed on the way of a sheet feed path, or other rollers.

Furthermore, the press member means a member disposed at a position opposing to the feeding roller, so as to increase the frictional force between the feeding roller and the sheet.

Moreover, the double feed detector signifies a means for detecting double feed of the sheets when the sheets are fed in superimposition.

Therefore, the double feed detector may be an ultrasonic wave sensor, an optical sensor, or a mechanic displacement detector which is displaced according to the thickness of the sheet in slide contact with the surface of the sheet to be fed.

Additionally, the region where the amplitude of the sheet is suppressed, means a region occupying the vicinity of a portion of the sheet held between the feeding roller and the press member, and having few fluctuation.

In the inventive sheet feeder, the region where the amplitude of the sheet is suppressed may be defined within a region in a direction perpendicular to a sheet feed direction from the sheet holding position.

With this configuration, double feed can be securely detected across the fore end and rear end of the sheet.

In the inventive sheet feeder, the press member may be a press roller for holding the sheet in cooperation with the feeding roller.

In the inventive sheet feeder, the press member may be a separating pad disposed so as to oppose to the feeding roller, and the separating pad may be brought into slide contact with the sheet.

Furthermore, in the inventive sheet feeder, the pressing member may be a rib extending in the sheet feed direction.

With these configurations, the sheet can be securely held by any press member out of the press roller, the separating pad and the rib, thereby effectively suppressing the amplitude of the sheet in the region adjacent to the sheet holding portion.

Incidentally, in the case where the press member is the press roller, the press roller may be a so-called separating roller equipped with the function of applying the frictional force in a direction reverse to the sheet feed direction in order to eliminate double feed of the sheets.

In the inventive sheet feeder, the feeding roller and the press member may include a plurality of pairs of feeding rollers and press members arranged in a direction perpendicular to the sheet feed direction, and the double feed detector may detect double feed of the sheets between the sheet holding portions being adjacent to each other.

With this configuration, since the sheet is held between the plurality of pairs of feeding rollers and press members, the sheet can be more securely held at the plurality of sheet holding portions, thereby more effectively suppressing the amplitude of the sheet. Furthermore, the double feed detector detects double feed of the sheets between the sheet holding portions being adjacent to each other, at which the amplitude of the sheet is suppressed, thus securely detecting double feed of the sheets with a higher accuracy.

In the above-described configuration in which the press member is the press roller, the feeding roller and the press roller may be pivoted, respectively, and the double feed detector may include a pair of an output element and an input element having an output surface and an input surface, respectively, the output element and the input element may be disposed slantwise with respect to a sheet surface in such a manner that an output emitted from the output surface of the output element input into the input surface of the input element through between respective shafts of the feeding roller and the press roller.

With this configuration, the output element and the input element are arranged slantwise with respect to the surface of the sheet so that the output emitted from the output surface of the output element input into the input surface of the input element through between the respective shafts of the feeding roller and the pressing roller. As a consequence, the double feed detector can be provided by effectively utilizing a limited space, thus avoiding a larger size of the sheet feeder. Moreover, the double feed detector can be provided anywhere at portions, at which the feeding roller and the pressing roller are arranged, in the sheet feeder, and thus, the freedom of design can be remarkably enhanced in providing the double feed detector.

In the above-described configuration in which the double feed detector includes a pair of an output element and an input element, the output element may be a wave transmitter for transmitting an ultrasonic wave, and the input element may be a wave receiver for receiving an ultrasonic wave.

With this configuration, the ultrasonic wave, which has been transmitted from the wave transmitter and has been attenuated through the sheet, can be received by the wave receiver, so that double feed of the sheets can be detected by comparing the attenuation degree of the ultrasonic wave with a threshold.

In this manner, double feed of the sheets can be detected without any contact with the sheet, and further, double feed of the sheets can be securely detected without being influenced by the thickness or color of the sheet.

From another viewpoint, the present invention also provides an image forming apparatus including the sheet feeder according to the present invention.

With the image forming apparatus according to the present invention, double feed of recording sheets can be securely detected while feeding the recording sheet at a high speed, thus exhibiting stable performance.

Incidentally, the image forming apparatus herein signifies an apparatus for forming an image on the recording sheet with a toner, ink or the like, such as a copying machine, a printer or a facsimile.

In addition, from a further viewpoint, the present invention also provides a document feeder including the sheet feeder according to the present invention.

With the document feeder according to the present invention, double feed of documents can be securely detected while feeding the document at a high speed, thus exhibiting stable performance.

Incidentally, the document feeder herein signifies a device for feeding a document to be read to an image reading unit, such as an auto document feeder (abbreviated as "an ADF") mounted on an image forming apparatus or a facsimile.

A detailed description will be given below of the invention by way of a preferred embodiment shown in the attached drawings.

Preferred Embodiment

Referring to FIGS. 1 to 11, explanation will be made below on an image forming apparatus mounting thereon an auto document feeder (sheet feeder), (hereinafter abbreviated as "ADF") according to a preferred embodiment of the present invention. FIG. 1 is a schematic view showing the entire configuration of an image forming apparatus in a preferred embodiment of the present invention.

Entire Configuration and Operation of Image Forming Apparatus

As shown in FIG. 1, an image forming apparatus 100 mounting thereon an ADF (sheet feeder) 1 according to a preferred embodiment of the present invention is adapted to form, on a predetermined recording sheet, a monochromatic image corresponding to image data obtained by scanning a document fed by the ADF 1 or image data transmitted from the outside.

The image forming apparatus 100 is constituted mainly of the ADF 1, an image reading unit 2, an optical writing unit 3, a developer 4, a photosensitive member 5, an electric charger 6, a cleaner unit 7, a transfer unit 8, a fixing unit 9, a sheet feed path 10, sheet supplying trays 11 and a sheet discharging tray 12.

The image reading unit 2 mainly includes a light source holder 13, a mirror group 14 consisting of mirrors, and a CCD 15.

In the case where a document fed by the ADF 1 is scanned, an image of the document is scanned in the state in which the light source holder 13 and the mirror group 14 are stationary.

When the document is fed by the ADF 1, a light source in the light source holder 13 irradiates the document with a light beam. The optical path of the light beam reflected on the document is changed via the mirror group 14, so that the image is focused on the CCD 15, which then converts the light beam into electronic image data.

Incidentally, specific structure and operation of the ADF 1 will be described later.

The electric charger 6 is electrically charging means for uniformly charging the surface of the photosensitive member 5 at a predetermined potential. Although the electric charger 6 of a charger type is used in the image forming apparatus 100 in the preferred embodiment, an electric charging roller or a brush of a contact type may also be used.

In addition, although the optical writing unit 3 consists of a laser scanning unit (abbreviated as "an LSU") provided with laser irradiators 16*a* and 16*b* and mirrors 17*a* and 17*b*, an EL writing head or an LED writing head having light emitting elements arrayed thereon may also be used.

The optical writing unit 3 adopts a 2-beam system including the two laser irradiators 16*a* and 16*b* in order to cope with high-speed printing, and therefore, it is possible to reduce a burden accompanied with the higher speed of an irradiation timing.

The laser irradiators 16*a* and 16*b* irradiate the light beams in accordance with the input image data, and then, expose the photosensitive member 5, which has been uniformly charged by the electric charger 6, by the light beams via the mirrors 17*a* and 17*b*, thus an electrostatic latent image is formed on the photosensitive member 5 in accordance with the image data.

The developer 4 disposed in the vicinity of the photosensitive member 5 is adapted to develop the electrostatic latent image formed on the photosensitive member 5 with a black toner.

Furthermore, the cleaner unit 7 disposed around the photosensitive member 5 is designed to remove and recycle a toner remaining on the photosensitive member 5 after the image is developed and transferred.

The image forming apparatus 100 includes a controller, not shown, for comprehensively controlling the entirety.

The controller is constituted of a CPU, a ROM which stores therein a control program to be executed by the CPU, a RAM which provides the CPU with a work area, a non-volatile memory which holds control data therein, an input circuit which receives a signal from each of detectors in the image forming apparatus 100, a driver circuit which drives an actuator or a motor for actuating each of drive mechanisms in the image forming apparatus 100, an output circuit which drives the laser irradiators 16*a* and 16*b*, and the like.

As described above, the electrostatic image developed on the photosensitive member 5 is transferred onto a recording sheet by applying an electric field having a polarity reverse to that of an electric charge of the electrostatic image to the sheet being fed from the transfer unit 8.

In the case where the electrostatic image has an electric charge of, for example, a minus polarity, a polarity applied by the transfer unit 8 is plus.

A transfer belt 19 in the transfer unit 8 is stretched across a driving roller 20, a driven roller 21 and other rollers, and has a predetermined resistance within a range of, for example, $1\times10^{9}$ Ω·cm to $1\times10^{13}$ Ω·cm.

At a contact portion between the photosensitive member 5 and the transfer belt 19 is disposed an elastic and conductive roller 22 which has conductivity and can apply a transfer electric field.

The electrostatic image with a not-fixed toner, which has been transferred onto the recording sheet by the transfer unit 8, is fed to the fixing unit 9, in which the not-fixed toner is fused and fixed onto the recording sheet.

The fixing unit 9 includes a heating roller 23 and a pressurizing roller 24. The heating roller 23 incorporates, at the inner circumference thereof, a heat source which heats the surface of the heating roller 23 up to a predetermined temperature, that is, a fixing temperature from about 160° C. to 200° C.

In contrast, the pressurizing roller 24 includes pressurizing members, not shown, at both ends thereof in such a manner as to be brought into press-contact with the heating roller 23 under a predetermined pressure.

In this manner, the not-fixed toner on the recording sheet being fed is heated and fused by the heating roller 23 at a press-contact portion, which is called a fixing-nipping portion, between the heating roller 23 and the pressurizing roller 24, and then, is fixed onto the recording sheet by an osmotic function at the press-contact portion.

The plurality of sheet supplying trays 11 are adapted to stack thereon the recording sheets for use in image formation, and are housed under in the image forming apparatus 100 in the preferred embodiment.

Since the image forming apparatus 100 in the preferred embodiment directs the high-speed printing, each of the sheet supplying trays 11 secures a capacity capable of stacking thereon 500 to 1500 pieces of recording sheets of a standardized size.

Moreover, a large capacity sheet supplying cassette (abbreviated as "an LCC") 25 capable of stacking thereon a great quantity of recording sheets of a plurality of types and a manual feeding tray 26 for use mainly in printing on a sheet of an irregular size are installed at a side surface of the image forming apparatus 100.

The sheet discharging tray 12 is disposed at a side surface opposite to the manual feeding tray 26. In place of the sheet discharging tray 12, a post-processor for a discharged sheet such as a stapler or a puncher or sheet discharging trays on a plurality of stages may be optionally installed.

Configuration and Operation of ADF

Figure 2:
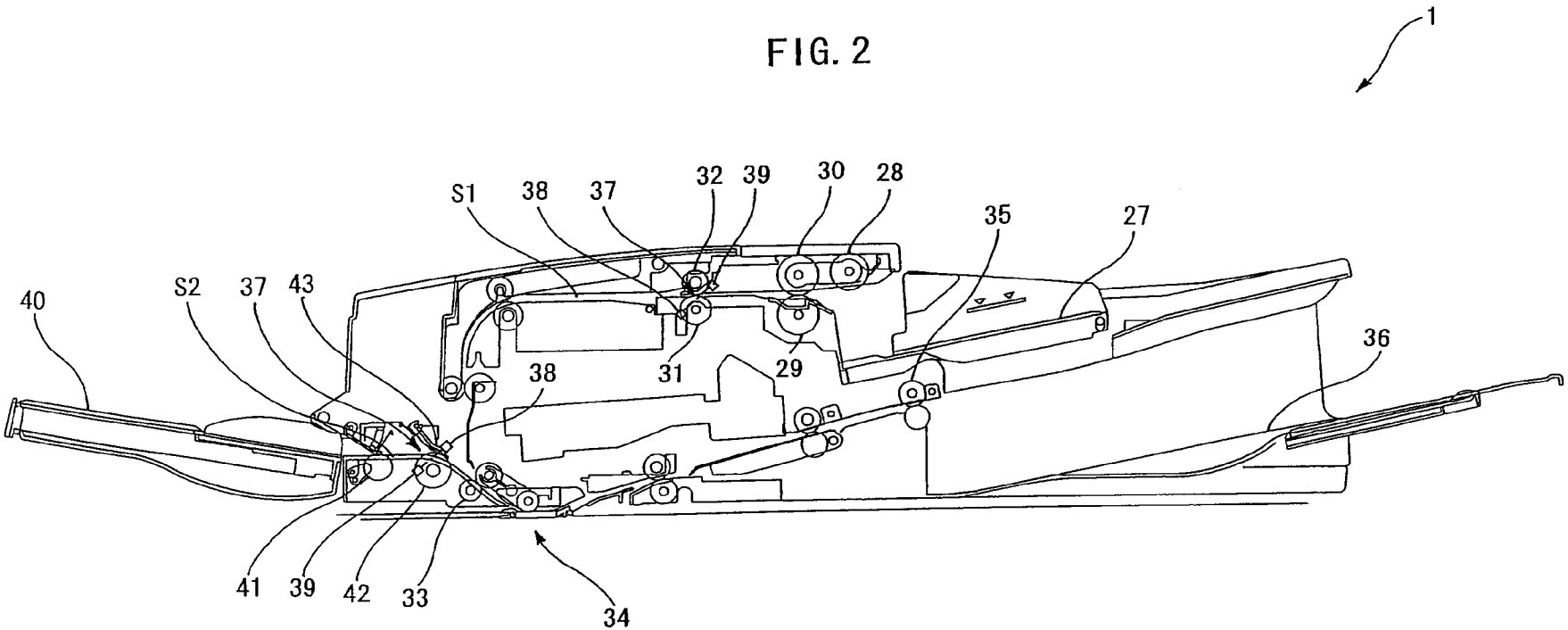
FIG. 2 is a schematic view showing a general configuration of the ADF according to the preferred embodiment of the present invention.
Figure 3:
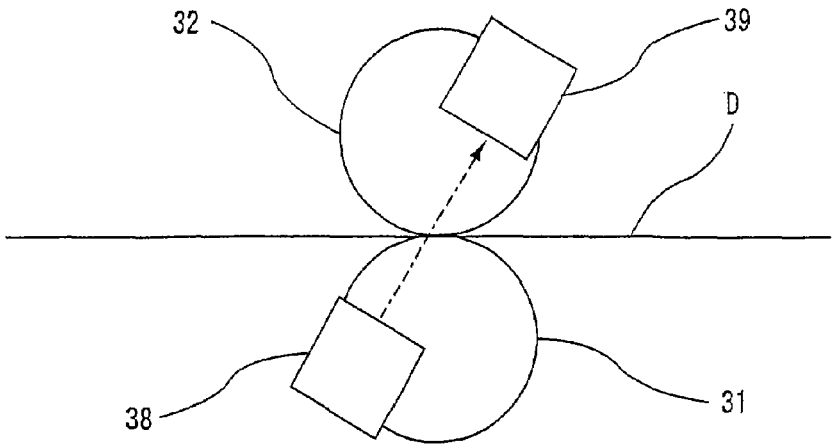
FIG. 3 is an enlarged explanatory view of the essential parts of the ADF shown in FIG. 2.
Figure 4:
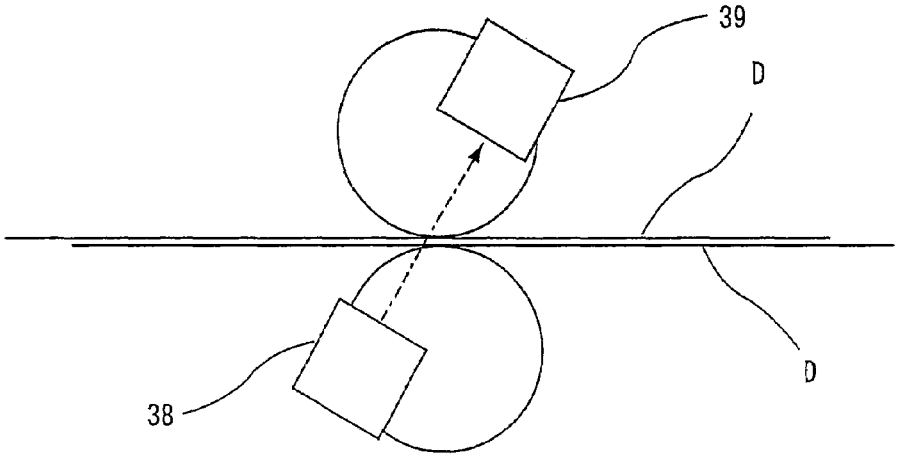
FIG. 4 is another enlarged explanatory view of the essential parts of the ADF shown in FIG. 2.
Figure 5:
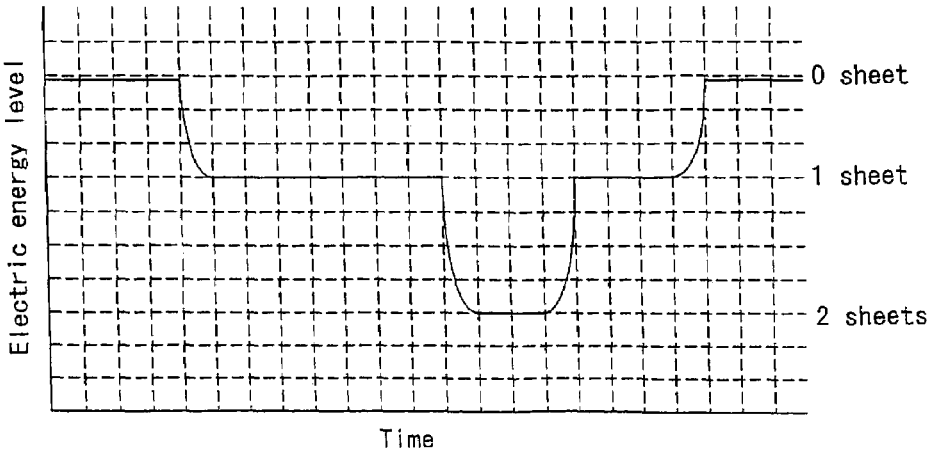
FIG. 5 is a graph conceptually illustrating the fluctuation of electric energy converted by a wave receiver since an ultrasonic wave is attenuated due to double feed of documents in the ADF according to the preferred embodiment of the present invention.
Figure 6:
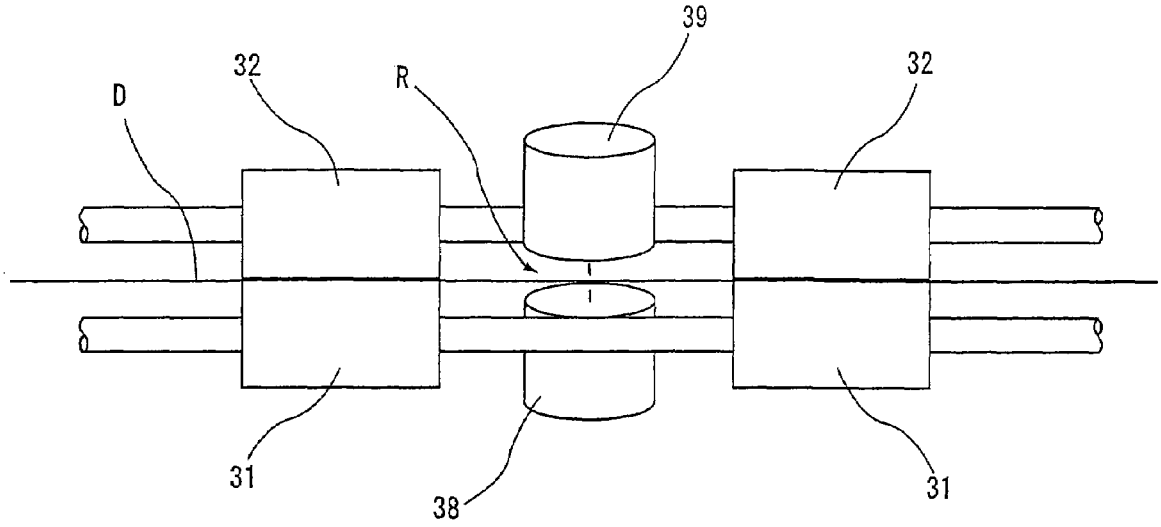
FIG. 6 is a further enlarged explanatory view of the essential parts of the ADF shown in FIG. 2.
Figure 7:
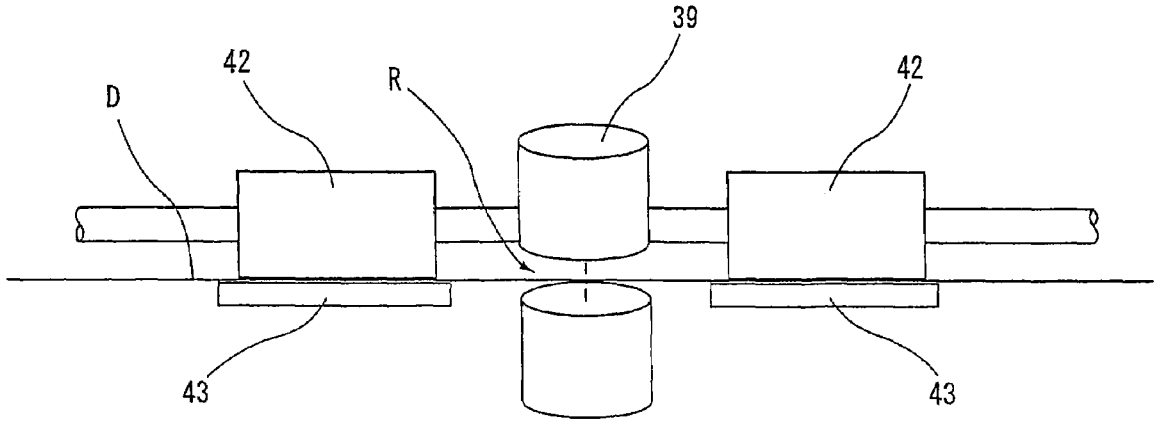
FIG. 7 is a still further enlarged explanatory view of the essential parts of the ADF shown in FIG. 2.
Figure 8:
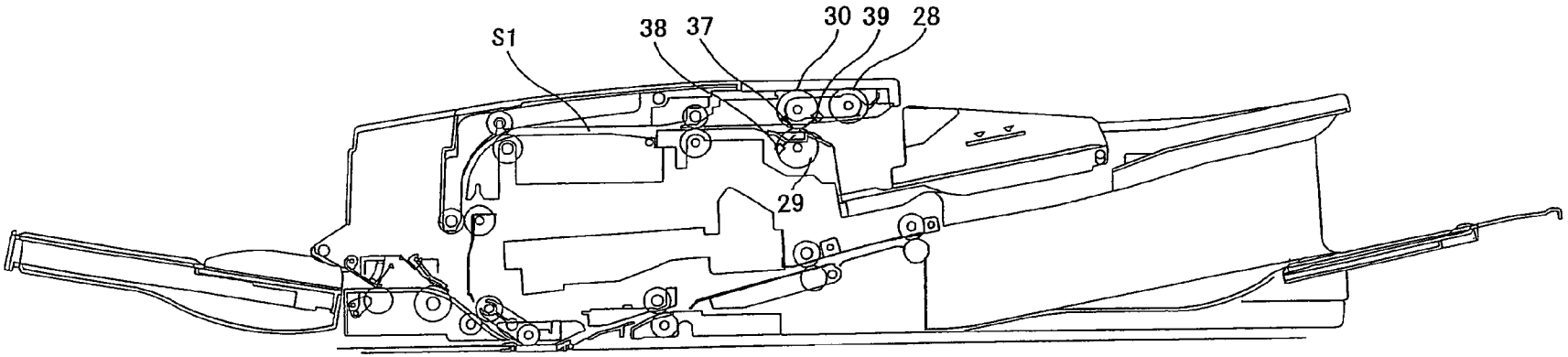
FIG. 8 is a schematic view showing a general configuration of an ADF according to a modification of the present invention.
Figure 9:
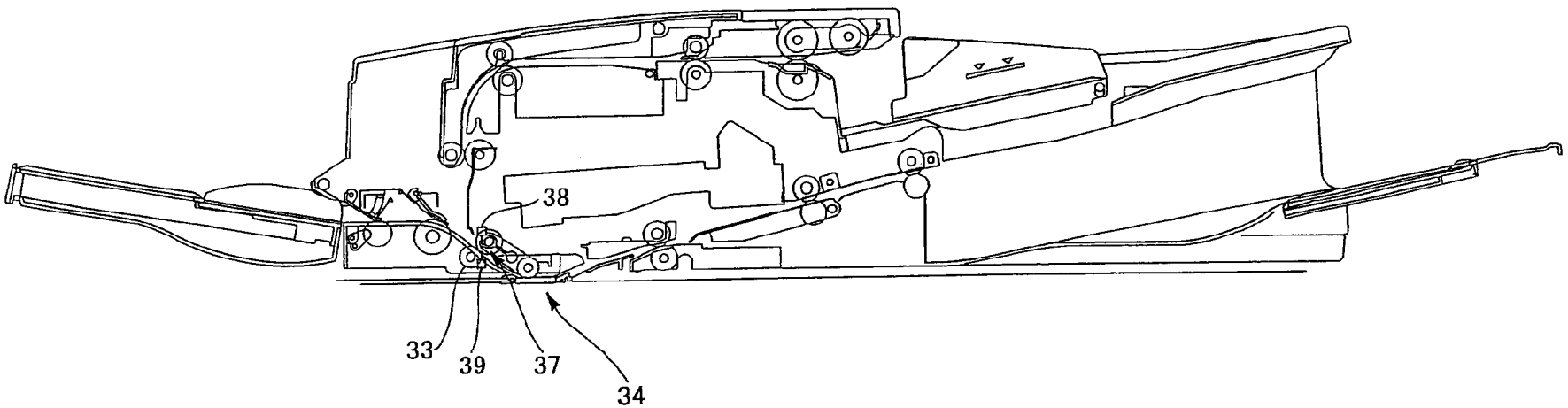
FIG. 9 is a schematic view showing a general configuration of an ADF according to another modification of the present invention.
Figure 10:
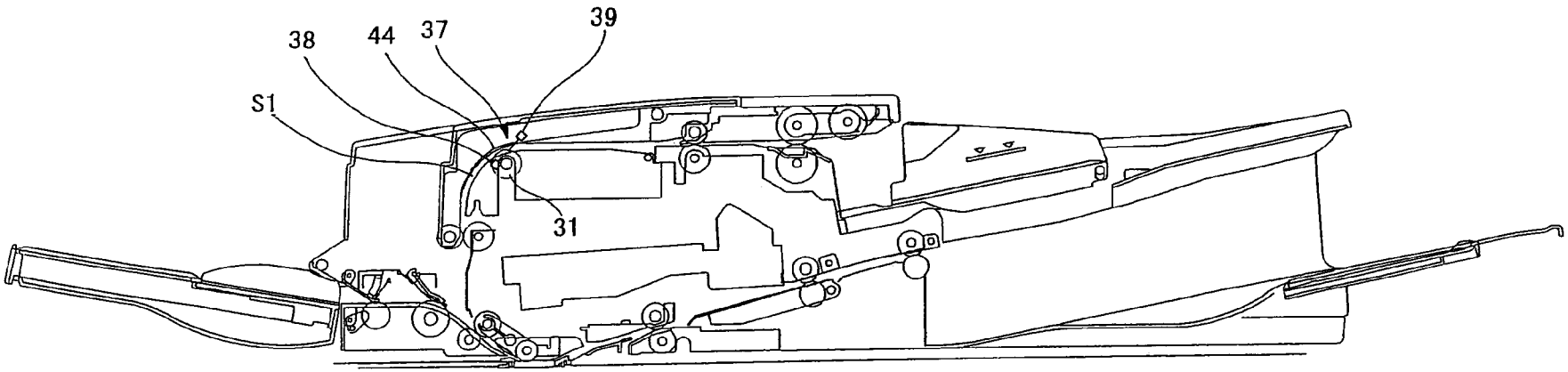
FIG. 10 is a schematic view showing a general configuration of an ADF according to a further modification of the present invention.
Figure 11:
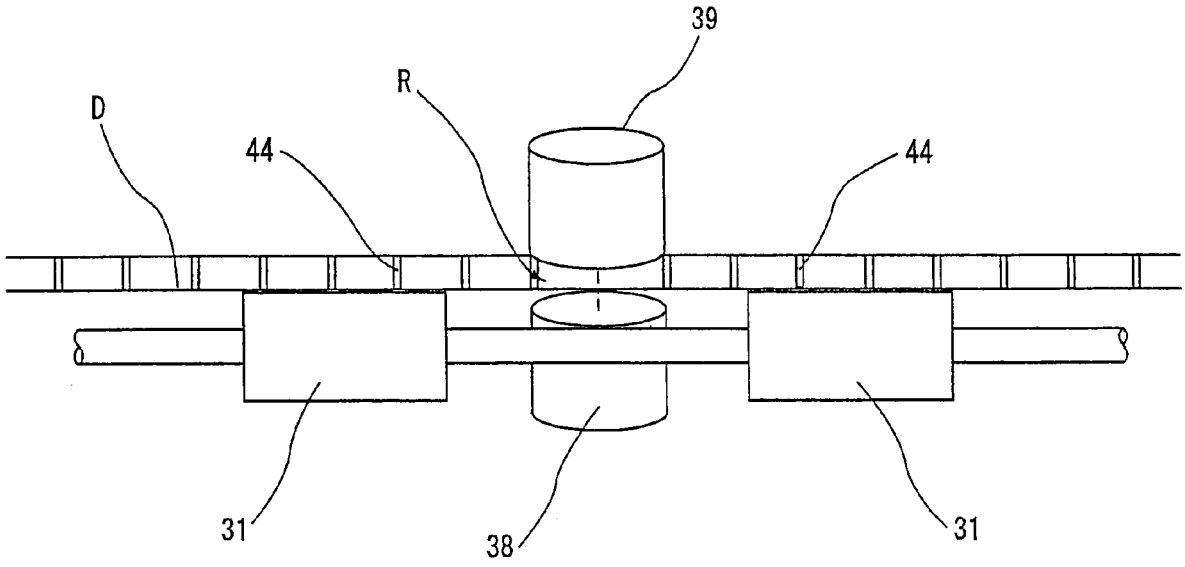
FIG. 11 is an enlarged explanatory view of the essential parts of the ADF shown in FIG. 10.

The ADF 1 mounted on the above-described image forming apparatus 100 will be explained in reference to FIGS. 2 to 11. FIG. 2 is a schematic view showing a general configuration of the ADF, that is, a sheet feeder according to the preferred embodiment of the present invention; FIGS. 3 and 4 are enlarged explanatory views of the essential parts of the ADF shown in FIG. 2; FIG. 5 is a graph conceptually illustrating the fluctuation of electric energy converted by a wave receiver since an ultrasonic wave is attenuated due to double feed of the documents in the ADF according to a preferred embodiment of the present invention; FIGS. 6 and 7 are enlarged views explanatory of the essential parts of the ADF shown in FIG. 2; FIGS. 8, 9 and 10 are schematic views showing a general configuration of ADFs according to modifications of the present invention; and FIG. 11 is an enlarged explanatory view of the essential parts of the ADF shown in FIG. 10.

As shown in FIG. 2, the ADF 1 mounted on the above-described image forming apparatus 100 (see FIG. 1) includes a feeding roller 31 for feeding the document, a press roller (press member) 32 for pressing the document against the feeding roller 31, and a double feed detector 37 for detecting double feed of the documents when the document are fed in superimposition. The feeding roller 31 and the press roller 32 are opposed each other at a document holding portion for holding the document to be fed therebetween. The double feed detector 37 is placed to be able to detect double feed of the documents in a region being adjacent to the document holding portion, an amplitude of the document being suppressed in the region.

Explanation will be made in more detail below on the ADF 1 according to the preferred embodiment of the present invention.

As shown in FIG. 2, the ADF 1 is constituted mainly of a document tray 27 on which a stack of documents mounted, a pick-up roller 28 for feeding the document from the stack of documents onto a document feed path S1, a document supplying roller 29 and a separating roller 30 for feeding the document downstream of the document feed path S1 while separating the documents one from another, the plurality of pairs of feeding rollers 31 and press rollers 32 for feeding the document along the document feed path S1, a registration roller 33 for feeding the document to a reading portion 34 at a predetermined timing, and a document discharging roller 35 for discharging the document whose image is finished to be read onto a document discharging tray 36.

The document tray 27 can be moved in upward and downward directions. When a sensor, not shown, detects that the stack of documents is mounted on the document tray 27, the document tray 27 is moved upward at a printing request by a user, and then, an uppermost document out of the stack of documents is fed onto the document feed path S1 by the pick-up roller 28.

Even if the documents are fed in superimposition onto the document feed path S1, the separating roller 30 normally eliminates a doubly fed state, and thus, the documents are fed one by one downstream of the document feed path S1 by the document supplying roller 29, as described above.

However, since the ADF 1 according to the preferred embodiment of the present invention feeds the document at a high speed so as to cope with the high-speed printing, there is a fear of double feed even with the separating roller 30.

In view of this, the ADF 1 according to the preferred embodiment of the present invention includes the double feed detector 37 in the vicinity of the feeding roller 31 and the press roller 32 disposed downstream of the document supplying roller 29 and the separating roller 30.

The double feed detector 37 is constituted of a wave transmitter 38 for transmitting an ultrasonic wave, and a wave receiver 39 for receiving the ultrasonic wave transmitted from the wave transmitter 38.

As shown in FIG. 3, when a document D is fed on the document feed path S1 (see FIG. 2) while the document D is held between the feeding roller 31 and the press roller 32, the ultrasonic wave transmitted from the wave transmitter 38 is attenuated through the document D, and then, is received by the wave receiver 39, to be thus converted into electric energy.

If the documents D should be doubly fed in superimposition, as shown in FIG. 4, the ultrasonic wave transmitted from the wave transmitter 38 is greatly attenuated due to a slight air layer formed between the superimposed documents D, and then, is received by the wave receiver 39, to be thus converted into electric energy.

As a result, the level of the electric energy converted by the wave receiver 39 is compared with a predetermined threshold, so that it can be detected as to whether the documents are normally fed one by one or they are abnormally fed in the doubly fed state, as illustrated in FIG. 5.

Here, since the ultrasonic wave is transmitted via air as a medium, if there is an amplitude, that is, a fluctuation in the document, to which the ultrasonic wave is transmitted, an output from the wave receiver 39 is fluctuated and it is difficult to accurately detect double feed. It is construed that the document approaching the wave receiver 39 while being vibrated applies a vibration on a level higher than usual to the wave receiver 39 via the air staying between the wave receiver 39 and the document so that a sensor in the wave receiver 39 is vibrated more largely than usual when the document ultrasonically vibrated with the application of the ultrasonic wave from the wave transmitter 38 approaches the wave receiver 39 due to the fluctuation, thereby causing the fluctuation of the output from the wave receiver 39 due to the fluctuation in the document.

Therefore, in the ADF 1 according to the preferred embodiment of the present invention, the wave transmitter 38 and the wave receiver 39 are disposed so as to detect double feed of the documents in a region R where the amplitude of the document D is suppressed as shown FIG. 6. That is, since the region R in the document D is defined between the document holding portions held by the plurality of pairs of the feeding rollers 31 and the press rollers 32 arranged in a direction perpendicular to the document feed direction, the amplitude of the document D is suppressed in the region R.

As shown in FIGS. 3 and 4, the wave transmitter 38 and the wave receiver 39 are disposed slantwise with respect to the surface of the document D such that the ultrasonic wave transmitted from the wave transmitter 38 is received by the wave receiver 39 through between the respective shafts of the feeding roller 31 and the pressing roller 32.

In this manner, the wave transmitter 38 irradiates the region R with the ultrasonic wave, and the wave receiver 39 receives the attenuated ultrasonic wave when passing through the region R. Since the region R in the document D is defined between the document holding portions, the amplitude of the document D is suppressed in the region R. Therefore, the wave transmitter 38 and the wave receiver 39 can detect double feed of the documents accurately without being influenced by the fluctuation of the output from the wave receiver due to the amplitude of the document D.

As described above, the wave transmitter 38 and the wave receiver 39 are arranged slantwise with respect to the surface of the document D in such a manner that the ultrasonic wave transmitted from the wave transmitter 38 is received by the wave receiver 39 through between the respective shafts of the feeding roller 31 and the pressing roller 32.

Therefore, a limited space defined inside of the ADF 1 can be effectively utilized. The ADF 1 never becomes large even if it is equipped with the double feed detecting function.

The above-described arrangement enables the double feed detector 37 to be disposed in the vicinity of the various rollers housed inside of the ADF 1.

Specifically, the ADF 1 in the preferred embodiment includes a sub tray 40 for a document made of thick paper or the like having stiffness, as shown in FIG. 2.

The document made of thick paper or the like placed on the sub tray 40 is fed onto a substantially straight document feed path S2 by a pickup roller 41, and then, is fed while being held between a sheet supplying roller 42 and a separating pad 43 serving as a press member, and reach at the document feed path S1.

Another double feed detector 37 constituted of the wave transmitter 38 and the wave receiver 39 is disposed also in the vicinity of the sheet supplying roller 42 and the separating pad 43.

Here, the plurality of pairs of the sheet supplying rollers 42 and the separating pads 43 are arranged in a direction perpendicular to a feed direction of the document D, and the wave transmitter 38 and the wave receiver 39 are interposed between the document holding portions being adjacent to each other, as shown in FIG. 7.

In this manner, the wave transmitter 38 and the wave receiver 39 can detect double feed in the region R where the amplitude of the document is suppressed. That is, the region R in the document D is defined between the document holding portion where the document is held by the plurality pairs of the sheet supplying roller 42 and the separating pad 43, thus, the amplitude of the document D is suppressed. Thus, the wave transmitter 38 and the wave receiver 39 can detect double feed of the documents accurately without being influenced by the amplitude of the document D.

The configuration of the ADF 1 in the preferred embodiment may be modified, as shown in FIGS. 8 and 9.

In a modification shown in FIG. 8, a double feed detector 37 constituted of a wave transmitter 38 and a wave receiver 39 is disposed in the vicinity of a sheet supplying roller 29 and a separating roller 30.

With this configuration, it is detected as to whether or not documents are doubly fed immediately after the documents are fed onto a document feed path S1 by a pickup roller 28. As a consequence, a user can manually eliminate double feed of the documents with ease by stopping the documents from being fed upon the detection of the double feed.

Otherwise, in another modification shown in FIG. 9, a double feed detector 37 constituted of a wave transmitter 38 and a wave receiver 39 is disposed in the vicinity of a registration roller 33.

With this configuration, a double feed detector 37 is disposed only in front of a reading unit 34, in which double feed must never occur. Consequently, the single double feed detector 37 can produce a profound effect.

Alternatively, in a further modification, a double feed detector 37 constituted of a wave transmitter 38 and a wave receiver 39 may be disposed at a portion, at which a document is held between a feeding roller 31 and a rib 44 serving as a press member on the way of a document feed path S1, as shown in FIGS. 10 and 11.

As described above in detail, according to the invention, the double feed detector is disposed in such a manner as to detect double feed of the sheets in the region, in which the amplitude of the sheet is suppressed, adjacent to the sheet holding portion, thereby securely detecting double feed of the sheets while feeding the sheet at a high speed. In addition, double feed of the sheets can be securely detected irrespective of the position of the double feed detector as long as the sheet is held between the feeding roller and the press member, with an attendant advantage of a very high freedom of a design.

Incidentally, although the double feed detector is disposed only in the ADF in the above-described preferred embodiment, the double feed detector may be disposed at the sheet supplying roller, the feeding roller, the registration roller or the like in the image forming apparatus in the same manner.

What is claimed is:

1. A sheet feeder with an ultrasonic double feed detector comprising:

a feeding roller for feeding a sheet;

a press roller for pressing the sheet against the feeding roller; and a double feed detector for detecting double feed of the sheets when the sheets are fed in superimposition;

wherein the feeding roller and the press roller include a plurality of pairs of feeding rollers and press rollers arranged in a direction perpendicular to a sheet feed direction and being spaced from each other, the feeding rollers and the press rollers being axially pivoted by shafts, respectively, each pair of the feeding rollers and the press rollers being opposed to each other at a sheet holding portion for holding the sheet to be fed therebetween; and the double feed detector includes a pair of an output element and an input element having an output surface and an input surface, respectively, the output element and the input element being disposed slantwise with respect to a surface of the sheet and opposed to each other through the sheet to be fed in such a manner that an output emitted from the output surface of the output element is input into the input surface of the input element through a space between respective shafts of the feeding rollers and the press rollers, the output element being a wave transmitter for transmitting an ultrasonic wave, the input element being a wave receiver for receiving an ultrasonic wave, and detects double feed of the sheets in a region defined between the sheet holding portions adjacent to each other along a direction perpendicular to the sheet feed direction, an amplitude of the sheet being suppressed in the region.

2. An image forming apparatus comprising the sheet feeder as set forth in claim 1.

3. A document feeder comprising the sheet feeder as set forth in claim 1.

* * * * *